US012515900B2

(12) United States Patent
Ando

(10) Patent No.: US 12,515,900 B2
(45) Date of Patent: Jan. 6, 2026

(54) SHEET STORAGE DEVICE AND IMAGE FORMATION SYSTEM INCLUDING SAME

(71) Applicant: KYOCERA Document Solutions Inc., Osaka (JP)

(72) Inventor: Yoshihiro Ando, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/731,612

(22) Filed: Jun. 3, 2024

(65) Prior Publication Data

US 2024/0400324 A1 Dec. 5, 2024

(30) Foreign Application Priority Data

Jun. 5, 2023 (JP) ..... 2023-092376

(51) Int. Cl.
*B65H 1/04* (2006.01)

(52) U.S. Cl.
CPC ..... *B65H 1/04* (2013.01); *B65H 2402/45* (2013.01); *B65H 2801/12* (2013.01)

(58) Field of Classification Search
CPC ... B65H 1/04; B65H 2402/45; B65H 2801/12
See application file for complete search history.

(56) References Cited

U.S. PATENT DOCUMENTS

2014/0070482 A1* 3/2014 Matsumoto ..... B65H 1/04 271/162
2016/0363905 A1* 12/2016 Wakimoto ..... G03G 21/1633
2020/0277151 A1* 9/2020 Hirabayashi ..... B41J 25/312
2021/0178780 A1* 6/2021 Taketsugu ..... B41J 11/007
2023/0202218 A1* 6/2023 Inoue ..... B65H 19/126 347/218

FOREIGN PATENT DOCUMENTS

JP 2004-96031 A 3/2004
JP 2010-8872 * 1/2010

* cited by examiner

*Primary Examiner* — Thomas A Morrison
(74) *Attorney, Agent, or Firm* — Stein IP, LLC

(57) ABSTRACT

A sheet storage device includes first and second frames, a cover, and a torque retention mechanism that includes a shaft to rotate in conjunction with pivoting of the cover, and generates a resistance torque against rotation of the shaft when the cover pivots to a closed position. The torque retention mechanism includes a first torque retention mechanism and a second torque retention mechanism. A shaft of the first torque retention mechanism is attached to a first support part disposed on a first frame side, while a shaft of the second torque retention mechanism is attached to a second support part disposed on a second frame side.

4 Claims, 10 Drawing Sheets

SHEET STORAGE DEVICE AND IMAGE FORMATION SYSTEM INCLUDING SAME

INCORPORATION BY REFERENCE

This application is based upon and claims the benefit of priority from the corresponding Japanese Patent Application No. 2023-092376 filed Jun. 5, 2023, the entire contents of which are hereby incorporated by reference.

BACKGROUND

The present disclosure relates to a sheet storage device and an image formation system including the same.

A conventional sheet storage device is equipped with a cover that is supported in an openable and closable manner (in a pivotable manner). When the cover is opened (pivoted in an opening direction), a sheet storage region is exposed. When the cover is closed (pivoted in a closing direction), the sheet storage region is closed.

For instance, the cover is supported in an openable and closable manner by a torque retention mechanism including a torque generation unit such as a torque limiter. In this way, a torque is generated when the cover pivots in the closing direction. In contrast, no torque is generated (as a free state) when the cover pivots in the opening direction.

SUMMARY

A sheet storage device according to a first aspect of the present disclosure includes first and second frames, a cover, and a torque retention mechanism. The first and second frames are disposed to face each other in a first direction perpendicular to an up and down direction, with a storage region of sheets between them. The cover is supported so as to pivot between a closed position and an opened position, on a fulcrum of an end part in a second direction perpendicular to the first direction in a horizontal direction. The cover covers the storage region from above when being in the closed position, and pivots from the closed position to the opened position so as to open above the storage region. The torque retention mechanism includes a shaft to be a pivot shaft of the cover and to rotate in conjunction with pivoting of the cover, and is configured to generate a resistance torque against rotation of the shaft when the cover pivots to the closed position. The torque retention mechanism includes a first torque retention mechanism disposed on the first frame, and a second torque retention mechanism disposed on the second frame. The first and second torque retention mechanisms each include the shaft separately. The shaft of the first torque retention mechanism is attached to a first support part of the cover disposed on a first frame side. The shaft of the second torque retention mechanism is attached to a second support part of the cover disposed on a second frame side.

An image formation system according to a second aspect of the present disclosure includes the sheet storage device described above, and an image forming apparatus. The image forming apparatus is linked with the sheet storage device. The sheet storage device feeds the image forming apparatus with the sheet. The image forming apparatus performs printing on the sheet fed from the sheet storage device.

DETAILED DESCRIPTION

Hereinafter, with reference to FIGS. 1 to 10, there are described a sheet storage device 100 according to an embodiment of the present disclosure and an image formation system 100S including the same.

<Structure of Image Formation System>

Figure 1:
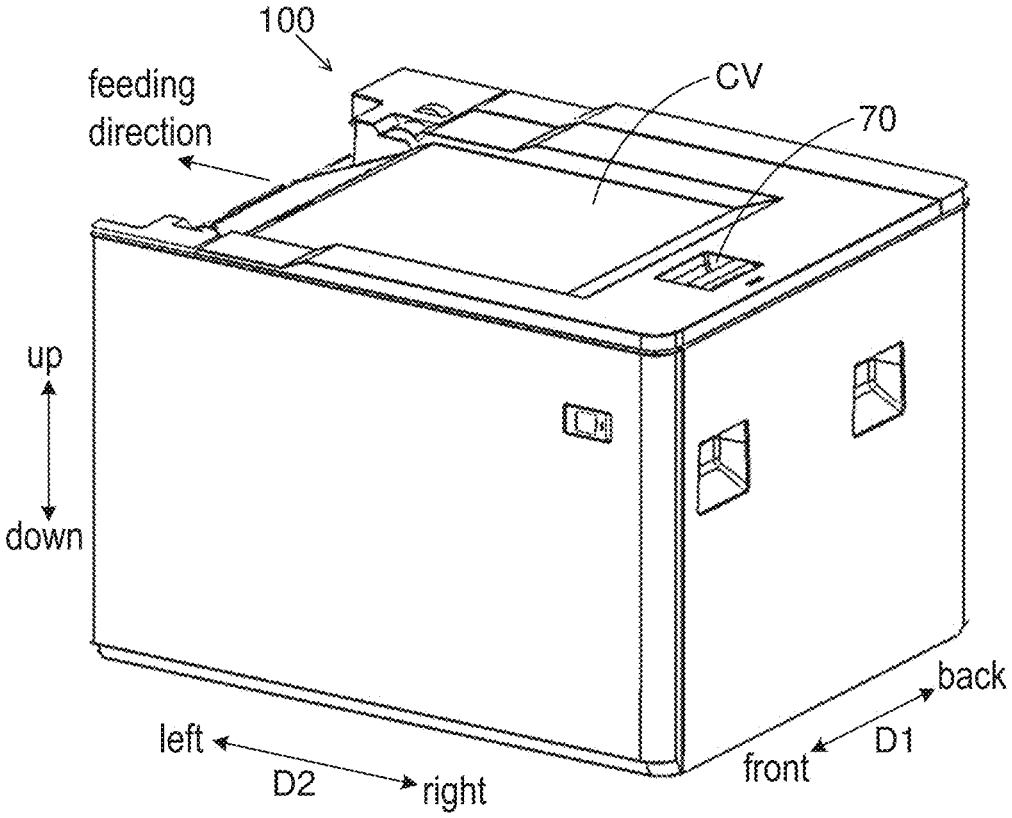
FIG. 1 is a perspective view of a sheet storage device according to an embodiment.
Figure 2:
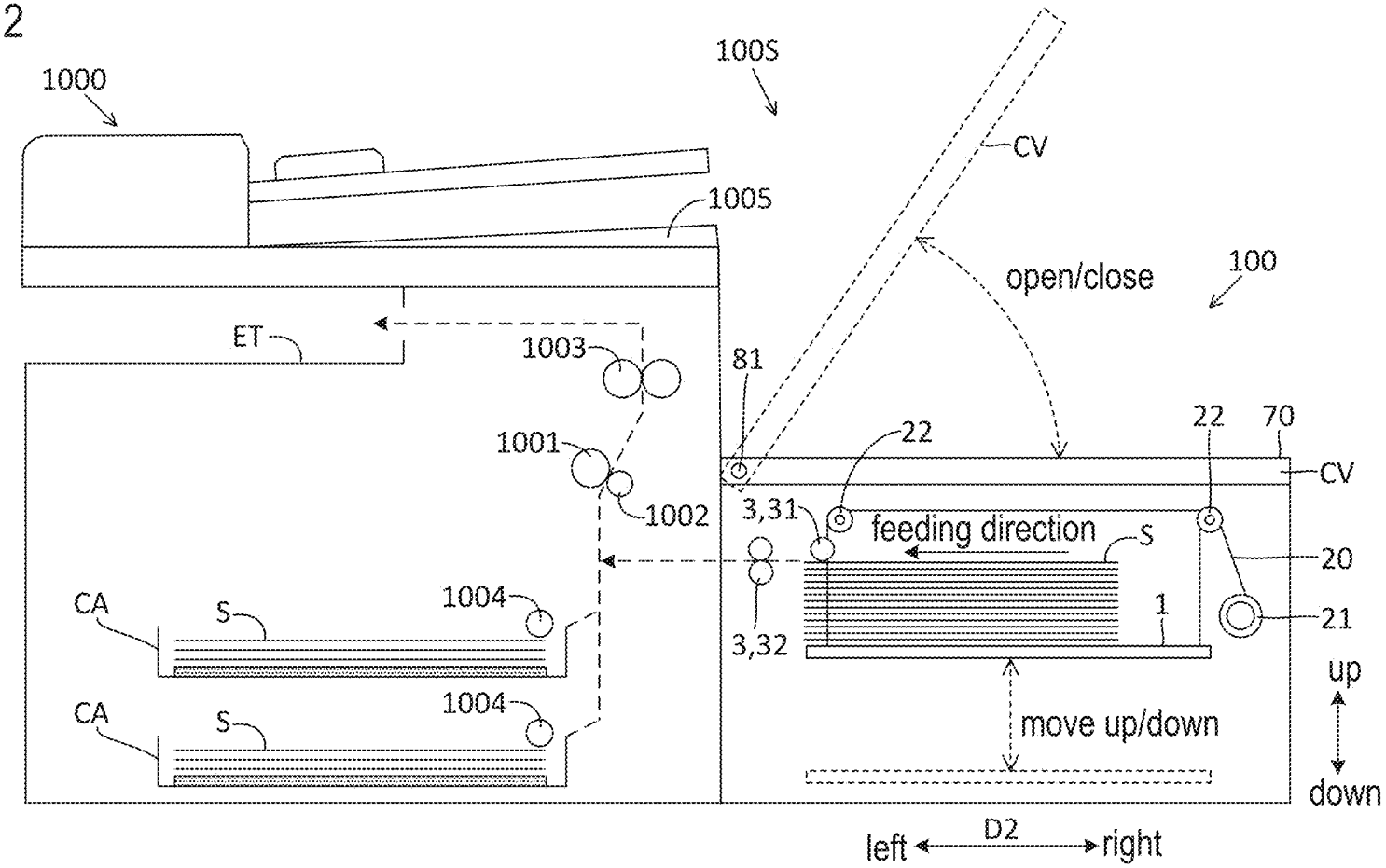
FIG. 2 is a schematic diagram of an image formation system including the sheet storage device according to the embodiment.

The sheet storage device 100 has an appearance as illustrated in FIG. 1. The sheet storage device 100 is linked with an image forming apparatus 1000 as illustrated in FIG. 2. When being linked with the image forming apparatus 1000, the sheet storage device 100 constitutes the image formation system 100S with the image forming apparatus 1000. FIG. 2 is a schematic diagram of the image formation system 100S (i.e., the sheet storage device 100 linked with the image forming apparatus 1000). FIG. 2 corresponds to a case where the image formation system 100S is viewed from front.

The sheet storage device 100 is installed with the image forming apparatus 1000 on a floor. The direction perpendicular to the floor (a flat surface) on which the sheet storage device 100 is installed corresponds to an "up and down direction".

Here, in horizontal directions perpendicular to the up and down direction, one direction corresponds to a "first direction", and the other direction perpendicular to the one direction corresponds to a "second direction". In the following description, the one direction of the horizontal directions is denoted by D1 and is simply referred to as a first direction D1, while the other direction of the horizontal directions is denoted by D2 and is simply referred to as a second direction D2.

The first direction D1 corresponds to a front and back direction when viewing the sheet storage device 100 from front. One side in the first direction D1 is a front side (i.e., a near side when viewing the device from front), and the other side opposite to the one side in the first direction D1 is a back side (i.e., a far side when viewing the device from front).

The second direction D2 corresponds to a left and right direction when viewing the sheet storage device 100 from front. One side in the second direction D2 is a right side, and the other side opposite to the one side in the second direction D2 is a left side.

The sheet storage device 100 is attachable and detachable from the image forming apparatus 1000. The sheet storage device 100 may be an optional device. The sheet storage device 100 is disposed on the right side of the image forming apparatus 1000.

The sheet storage device 100 stores sheets S. For instance, the sheet S is a paper sheet. The sheet storage device 100 feeds the sheet S to the image forming apparatus 1000. In other words, the sheet storage device 100 functions as a feeding device.

On the right side of the image forming apparatus 1000, the sheet storage device 100 feeds the sheet S to the image forming apparatus 1000, from the right side to the left side. In other words, in the second direction D2, the direction from the right side to the left side is a feeding direction of the sheet S from the sheet storage device 100 to the image forming apparatus 1000. In this structure, the first direction D1 is a direction perpendicular to the feeding direction of the sheet S.

The image forming apparatus 1000 prints an image on the sheet S fed from the sheet storage device 100. A printing method of the image forming apparatus 1000 is an electrophotographic method. It may also be possible that the printing method of the image forming apparatus 1000 is an inkjet method.

<Structure of Image Forming Apparatus>

The image forming apparatus 1000 conveys the sheet S fed from the sheet storage device 100, along a conveying path. The image forming apparatus 1000 prints an image on the sheet S under conveyance. Note that the conveying path of the sheet S is shown by a broken line with an arrow in FIG. 2.

The image forming apparatus 1000 includes a photosensitive drum 1001 and a transfer roller 1002. The photosensitive drum 1001 carries a toner image on its outer circumference surface. The transfer roller 1002 is pressed to contact the photosensitive drum 1001, so as to form a transfer nip with the photosensitive drum 1001. The transfer roller 1002 rotates together with the photosensitive drum 1001. When the sheet S under conveyance enters in the transfer nip, a transfer process is performed on the sheet S, and the toner image is transferred onto the sheet S.

Although not illustrated, the image forming apparatus 1000 further includes a charging device, an exposure device, and a development device. The charging device charges the outer circumference surface of the photosensitive drum 1001. The exposure device forms an electrostatic latent image on the outer circumference surface of the photosensitive drum 1001. The development device develops the electrostatic latent image on the outer circumference surface of the photosensitive drum 1001 into the toner image.

The image forming apparatus 1000 includes a fixing roller pair 1003. The fixing roller pair 1003 includes a heating roller and a pressure roller. A heater is embedded in the heating roller. The pressure roller is pressed to contact the heating roller so as to form a fixing nip with the heating roller. The pressure roller rotates with the heating roller. When the sheet S under conveyance enters the fixing nip, a fixing process is performed on the sheet S, and the toner image is fixed to the sheet S. The sheet S after passing through the fixing nip is discharged onto a discharge tray ET.

Note that the image forming apparatus 1000 includes a feed roller 1004. The feed roller 1004 feeds the sheet S to the conveying path from a sheet cassette CA disposed in a main body of the image forming apparatus 1000. In other words, the image forming apparatus 1000 can also print on the sheet S set in the sheet cassette CA.

In addition, the image forming apparatus 1000 includes an image reading device 1005. The image reading device 1005 reads an original so as to generate image data of the original. The image forming apparatus 1000 can print an image based on the image data of the original on the sheet S (i.e., can copy the original).

<Structure of Sheet Storage Device>

Figure 3:
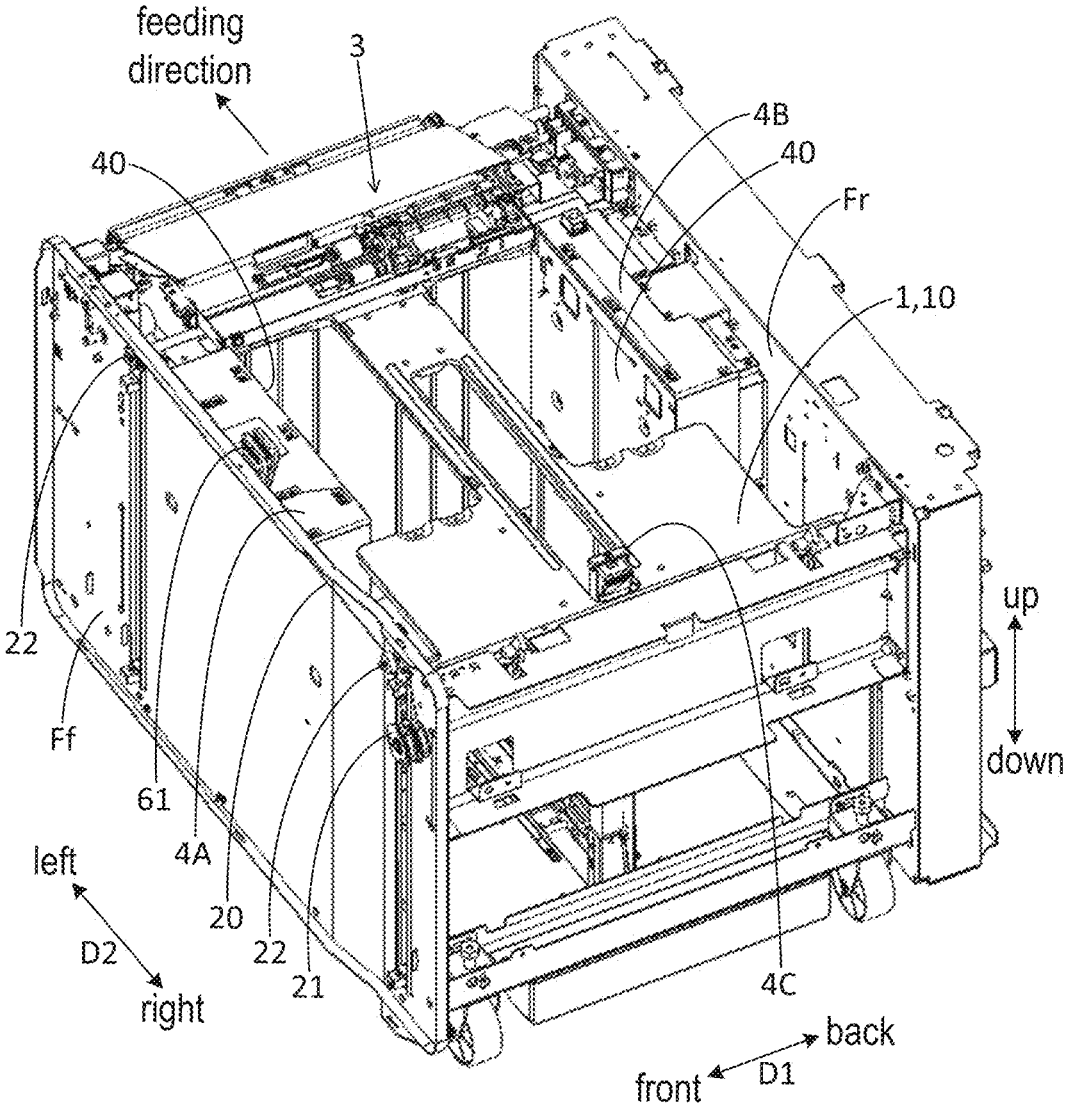
FIG. 3 is a perspective view of the sheet storage device according to the embodiment, without an outer cover.

As illustrated in FIG. 3, the sheet storage device 100 has a front frame Ff and a rear frame Fr. The front frame Ff corresponds to a "first frame", and the rear frame Fr corresponds to a "second frame".

The front frame Ff and the rear frame Fr are plate-like frames and are made of metal sheet. The front frame Ff is disposed on the front side, and the rear frame Fr is disposed on the back side. The front frame Ff has a front surface part whose thickness direction is the first direction D1, and the rear frame Fr has a rear surface part whose thickness direction is the first direction D1. The front frame Ff and the rear frame Fr are disposed in such a manner that the front surface part and the rear surface part face each other in the first direction D1.

The sheet storage device 100 has a sheet storage region between the front frame Ff and the rear frame Fr in the first direction D1. The sheets S are stored in the sheet storage region. The front frame Ff and the rear frame Fr are disposed to face each other in the first direction D1 with the sheet storage region between them. The sheet storage device 100 includes a top cover CV (see FIGS. 1 and 2). The top cover CV corresponds to a "cover". The sheet storage region is covered by the top cover CV from above.

The top cover CV is supported by the front frame Ff and the rear frame Fr in a pivotable manner. The top cover CV is pivotable about an axis extending in the first direction D1. The top cover CV pivots on a fulcrum of a left side end part in the second direction D2, so that the right side end part in the second direction D2 moves up and down. In other words, the top cover CV opens and closes an upper opening of the sheet storage region.

When the right side end part of the top cover CV moves upward (i.e., when the top cover CV is opened), the upper opening of the sheet storage region is exposed. Then, in the state where the top cover CV is opened, the sheets S are put into the sheet storage region through the upper opening of the sheet storage region. In this state, the right side end part of the top cover CV is moved downward (in other words, the top cover CV is closed), and thus the upper opening of the sheet storage region is closed. Note that an opening and closing mechanism of the top cover CV will be described later in detail.

The sheet storage device 100 includes a setting plate 1. The setting plate 1 is made of metal sheet. The setting plate 1 is disposed in the sheet storage region that is a region between the front frame Ff and the rear frame Fr in the first direction D1. In other words, the front frame Ff and the rear frame Fr are disposed so as to face each other in the first direction D1 with the setting plate 1 between them. Further, in other words, the front frame Ff and the rear frame Fr are disposed outward of the setting plate 1 in the first direction D1. The front frame Ff is disposed frontward of the setting plate 1 in the first direction D1. The rear frame Fr is disposed backward of the setting plate 1 in the first direction D1.

Note that "outward in the first direction D1" means the direction from the center of the sheet storage region in the first direction D1 to the front side or the back side of the sheet storage region in the first direction D1. For instance, "outward in the first direction D1 of the front frame Ff" means the front side of the front frame Ff in the first direction D1 (i.e., the outside opposite to the sheet storage region side of the front frame Ff), and "outward in the first direction D1 of the rear frame Fr" means the back side of the rear frame Fr in the first direction D1 (i.e., the outside opposite to the sheet storage region side of the rear frame Fr).

On the other hand, "inward in the first direction D1" means the direction from the front side or the back side of the sheet storage region in the first direction D1 to the center of the sheet storage region in the first direction D1. For instance, "inward in the first direction D1 of the front frame Ff" means the back side of the front frame Ff in the first direction D1 (i.e., the sheet storage region side of the front frame Ff), and "inward in the first direction D1 of the rear frame Fr" means the front side of the rear frame Fr in the first direction D1 (i.e., the sheet storage region side of the rear frame Fr).

The setting plate 1 has a setting part 10 in which the sheets S are set, in the sheet storage region. The sheets S are stacked in the up and down direction on the setting plate 1. The setting plate 1 is supported in a manner capable of reciprocating in the up and down direction.

Figure 4:
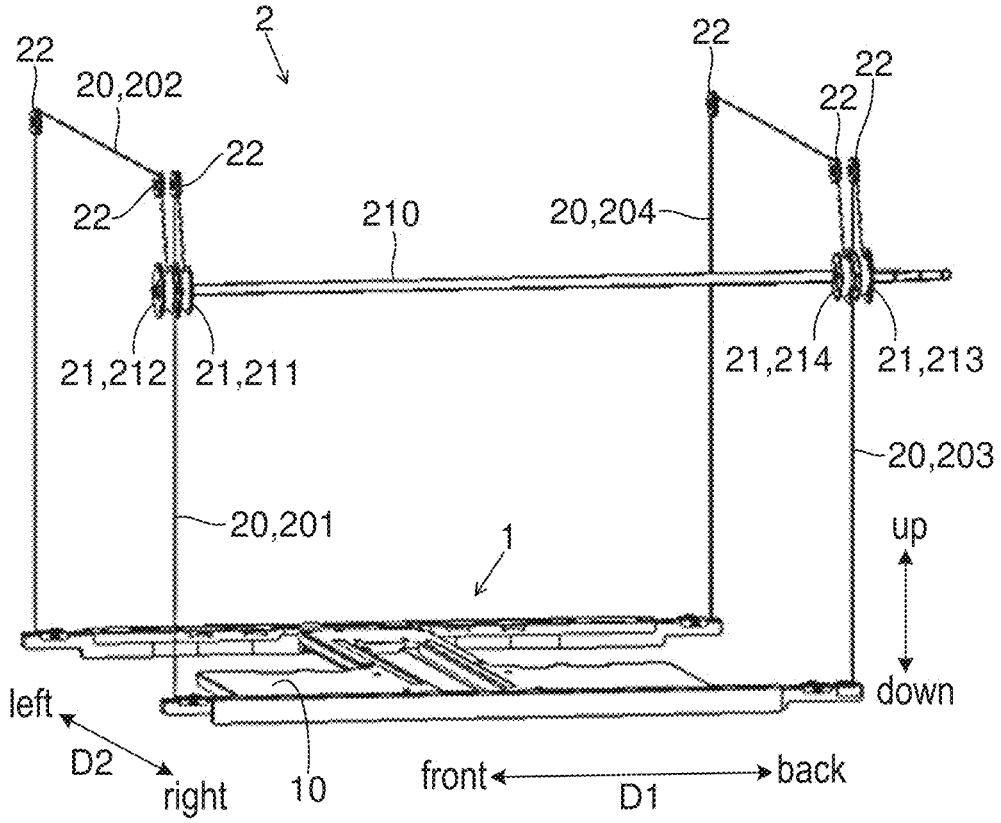
FIG. 4 is a perspective view of an elevating mechanism of a setting plate in the sheet storage device according to the embodiment.
Figure 5:
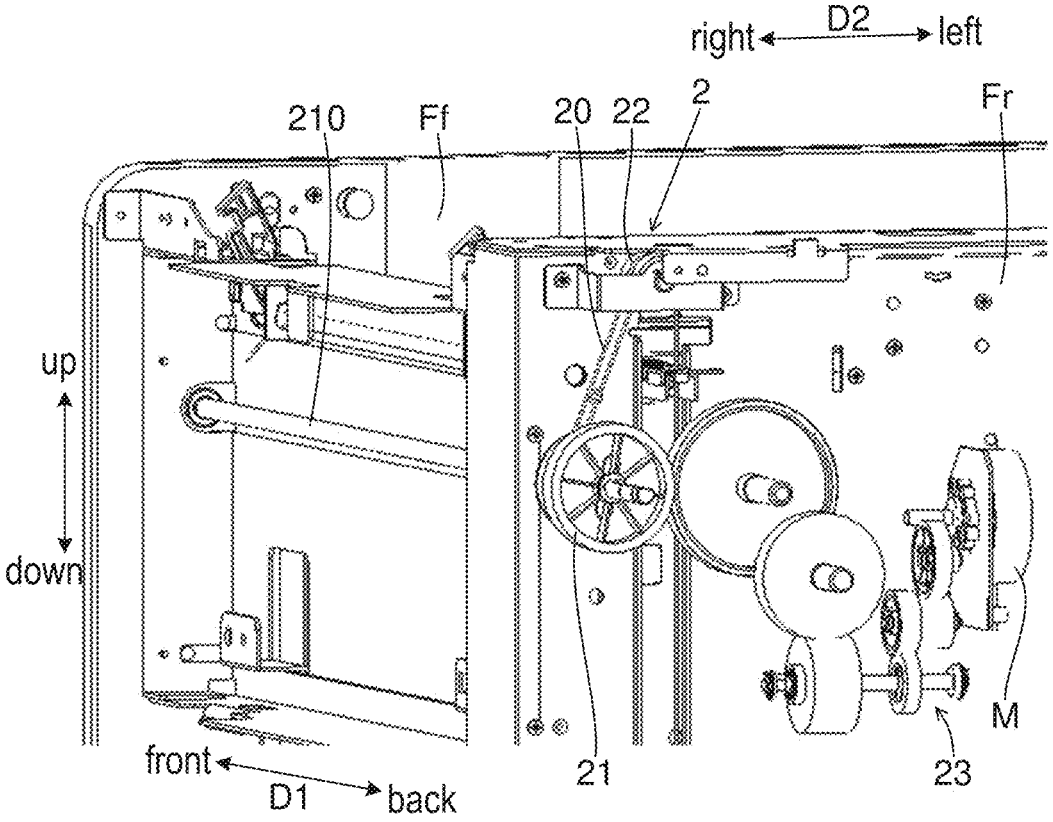
FIG. 5 is a perspective view of a winding motor and its vicinity of the elevating mechanism illustrated in FIG. 4.

The sheet storage device 100 includes an elevating mechanism 2. A structure of the elevating mechanism 2 is illustrated in FIGS. 4 and 5. The elevating mechanism 2 moves the setting plate 1 in the up and down direction. The elevating mechanism 2 moves the setting plate 1 upward, so as to maintain a position in the up and down direction of the top one of the sheets S set on the setting plate 1.

The elevating mechanism 2 includes wires 20 linked with the setting plate 1. The wires 20 include a first wire 201 whose one end is linked with a right front side end part of the setting plate 1, a second wire 202 whose one end is linked with a left front side end part of the setting plate 1, a third wire 203 whose one end is linked with a right back side end part of the setting plate 1, and a fourth wire 204 whose one end is linked with a left back side end part of the setting plate 1. The elevating mechanism 2 winds or unwinds the wires 20 so as to move the setting plate 1 upward or downward.

The elevating mechanism 2 includes winding drums 21, relay pulleys 22, and a winding motor M. The winding drums 21 include a first winding drum 211 linked with the other end of the first wire 201, a second winding drum 212 linked with the other end of the second wire 202, a third winding drum 213 linked with the other end of the third wire 203, and a fourth winding drum 214 linked with the other end of the fourth wire 204. When each of the first to fourth winding drums 211 to 214 rotates forward, it winds the wire 20 linked with itself, while when it rotates backward, it unwinds the wire 20 linked with itself.

The first winding drum 211 and the second winding drum 212 are disposed outward in the first direction D1 of the front frame Ff. The third winding drum 213 and the fourth winding drum 214 are disposed outward in the first direction D1 of the rear frame Fr.

The first winding drum 211 and the second winding drum 212 are arranged in this order from the front frame Ff side outward in the first direction D1. The fourth winding drum 214 and the third winding drum 213 are arranged in this order from the rear frame Fr side outward in the first direction D1.

The first to fourth winding drums 211 to 214 are supported in a rotatable manner about the same axis extending in the first direction D1. Specifically, the first to fourth winding drums 211 to 214 are attached to the same rotation shaft 210, and rotate together with the rotation shaft 210. One end part of the rotation shaft 210 in the axis direction is supported by the front frame Ff in a rotatable manner, and the other end part in the axis direction opposite to the one end part is supported by the rear frame Fr in a rotatable manner, so that the rotation shaft 210 extends in parallel to the first direction D1. The first winding drum 211 and the second winding drum 212 are disposed in the right side end part of the front frame Ff in the second direction D2, while the third winding drum 213 and the fourth winding drum 214 are disposed in the right side end part of the rear frame Fr in the second direction D2. In other words, one end part of the rotation shaft 210 is supported in a rotatable manner by the right side end part of the front frame Ff in the second direction D2, and the other end part of the rotation shaft 210 is supported in a rotatable manner by the right side end part of the rear frame Fr in the second direction D2.

When the winding motor M is driven, it rotates the rotation shaft 210. When the rotation shaft 210 rotates, the first to fourth winding drums 211 to 214 rotate. The winding motor M is disposed outward in the first direction D1 of the rear frame Fr. The winding motor M is linked with the back side end part of the rotation shaft 210 via a transmission mechanism 23 including a plurality of gears such as a screw gear.

Three relay pulleys 22 are disposed outward in the first direction D1 of the front frame Ff, and three relay pulleys 22 are disposed outward in the first direction of the rear frame Fr. The three relay pulleys 22 on the front side are supported by the front frame Ff in a rotatable manner, and the three relay pulleys 22 on the back side are supported by the rear frame Fr in a rotatable manner. Each of the relay pulleys 22 is disposed higher than the rotation shaft 210 in the up and down direction.

The first wire 201 extends from the setting plate 1, wraps around the one relay pulley 22, and reaches the first winding drum 211. The second wire 202 wraps around the two relay pulleys 22. One relay pulley 22 for the second wire 202 is positioned at the left side of the other relay pulley 22 for the second wire 202 in the second direction D2. The other relay pulley 22 for the second wire 202 rotates about the same axis as the relay pulley 22 for the first wire 201. The second wire 202 extends from the setting plate 1, wraps around the two relay pulleys 22, and reaches the second winding drum 212.

The third wire 203 extends from the setting plate 1, wraps around the one relay pulley 22, and reaches the third winding drum 213. The fourth wire 204 wraps around the two relay pulleys 22. One relay pulley 22 for the fourth wire 204 is positioned at the left side of the other relay pulley 22 for the fourth wire 204 in the second direction D2. The other relay pulley 22 for the fourth wire 204 rotates about the same axis as the relay pulley 22 for the third wire 203. The fourth wire 204 extends from the setting plate 1, wraps around the two relay pulleys 22, and reaches the fourth winding drum 214.

When the winding motor M rotates forward, the winding drum 21 winds the wire 20. In this way, the setting plate 1 moves upward. On the other hand, when the winding motor M rotates backward, the wire 20 is unwound from the winding drum 21. In this way, the setting plate 1 moves downward.

As illustrated in FIGS. 2 and 3, the sheet storage device 100 includes a feeding unit 3. The feeding unit 3 feeds the sheet S from the sheet storage device 100 (i.e., the sheet storage region) to the image forming apparatus 1000. The feeding unit 3 includes a pickup roller 31 and a conveying roller pair 32.

The pickup roller 31 is supported in a rotatable manner. The pickup roller 31 is disposed at a position capable of contacting a downstream side end part of the sheet S in the feeding direction from above, in the state where the sheet S is set on the setting plate 1. The pickup roller 31 is supported in a rotatable manner. The pickup roller 31 contacts the sheet S set on the setting plate 1 from above and rotates in this state, so as to pull out the sheet S from the setting plate 1.

The conveying roller pair 32 is supported in a rotatable manner. The conveying roller pair 32 is a pair of rollers that are pressed to contact each other. The conveying roller pair 32 is disposed on the downstream side of the pickup roller 31 in the feeding direction. The conveying roller pair 32 pinches the sheet S pulled out from the setting plate 1 by the pickup roller 31, and rotates. In this way, the conveying roller pair 32 conveys the sheet S to the image forming apparatus 1000. The number of disposed conveying roller pairs 32 is not particularly limited, but it can be changed depending on factors such as a conveying path length for the sheet S from the pickup roller 31 to the image forming apparatus 1000.

The sheet S on the setting plate 1 is sent out from the right side to the left side in the second direction D2. In other words, on the setting plate 1, the left side end of the sheet S in the second direction D2 is a front end, while the right side end of the sheet S in the second direction D2 is a rear end. In addition, on the setting plate 1, the first direction D1 (i.e., the front and back direction) is a width direction of the sheet S.

Note that the elevating mechanism 2 moves the setting plate 1 upward, so as to allow the pickup roller 31 to contact the top one of the sheets S on the setting plate 1. In a case where the sheets S are fed continuously from the sheet storage device 100 to the image forming apparatus 1000, the elevating mechanism 2 repeats moving the setting plate 1 upward and stopping the same. In this way, the contact between the pickup roller 31 and the top one of the sheets S on the setting plate 1 is maintained.

Figure 6:
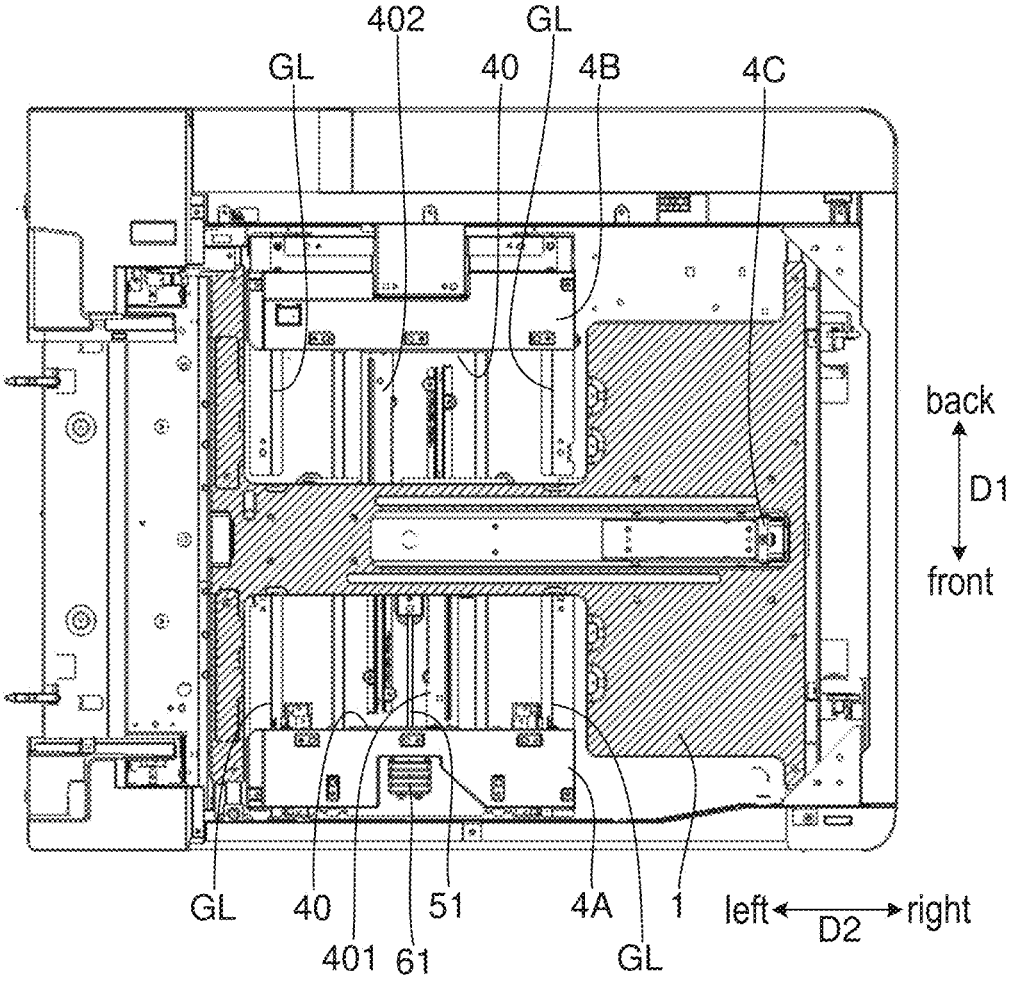
FIG. 6 is a plan view of a sheet storage region of the sheet storage device according to the embodiment, viewed from above.

As illustrated in FIG. 6, the sheet storage device 100 includes width direction regulation cursors 4A and 4B, and a rear end regulation cursor 4C. The width direction regulation cursor 4A, the width direction regulation cursor 4B, and the rear end regulation cursor 4C are supported in a manner capable of reciprocating in the horizontal direction. The width direction regulation cursor 4A, the width direction regulation cursor 4B, and the rear end regulation cursor 4C are moved in the horizontal direction by user's operation. Then, the width direction regulation cursor 4A, the width direction regulation cursor 4B, and the rear end regulation cursor 4C contact edges of the sheet S set on the setting plate 1, from the horizontal direction. In this way, the width direction regulation cursor 4A, the width direction regulation cursor 4B, and the rear end regulation cursor 4C regulate positional deviations in the horizontal direction of the sheet S on the setting plate 1.

The width direction regulation cursors 4A and 4B move in the first direction D1, and contact the edges of the sheet S on the setting plate 1 in the first direction D1, so as to regulate a positional deviation in the first direction D1 of the sheet S on the setting plate 1. Note that the width direction regulation cursors 4A and 4B sandwich the sheet S on the setting plate 1 in the first direction D1. The rear end regulation cursor 4C moves in the second direction D2, and contacts the edge of the sheet S on the setting plate 1 in the second direction D2, so as to regulate a positional deviation in the second direction D2 of the sheet S on the setting plate 1.

Note that when viewing from above, the setting plate 1 has openings (no numeral) on moving paths of the width direction regulation cursors 4A and 4B, and an opening (no numeral) on a moving path of the rear end regulation cursor 4C. Therefore, when the width direction regulation cursors 4A and 4B move in the first direction D1, they do not contact the setting plate 1. When the rear end regulation cursor 4C moves in the second direction D2, it does not contact the setting plate 1. In other words, viewed from above, even if the sheet Sis smaller than the setting plate 1, the width direction regulation cursors 4A and 4B can contact the edges of the sheet S without contacting the setting plate 1, and the rear end regulation cursor 4C can contact the edge of the sheet S without contacting the setting plate 1. In FIG. 6, the setting plate 1 is shown with hatching.

The width direction regulation cursor 4A contacts the edge of the sheet S from the front side in the first direction D1, and the width direction regulation cursor 4B contacts the edge of the sheet S from the back side in the first direction D1. Specifically, the width direction regulation cursors 4A and 4B each have a plate-like side surface part 40 that contacts the edge of the sheet S. The side surface part 40 of each of the width direction regulation cursors 4A and 4B stands in the up and down direction, and its thickness direction is the first direction D1. The side surface parts 40 of the width direction regulation cursors 4A and 4B face each other in the first direction D1.

The width direction regulation cursors 4A and 4B move in the first direction D1 in an interlocking manner. When the width direction regulation cursor 4A moves backward, the width direction regulation cursor 4B moves frontward, and hence an interval between the width direction regulation cursors 4A and 4B in the first direction D1 becomes smaller. When width direction regulation cursor 4A moves frontward, the width direction regulation cursor 4B moves backward, and hence the interval between the width direction regulation cursors 4A and 4B in the first direction D1 becomes larger.

Figure 7:
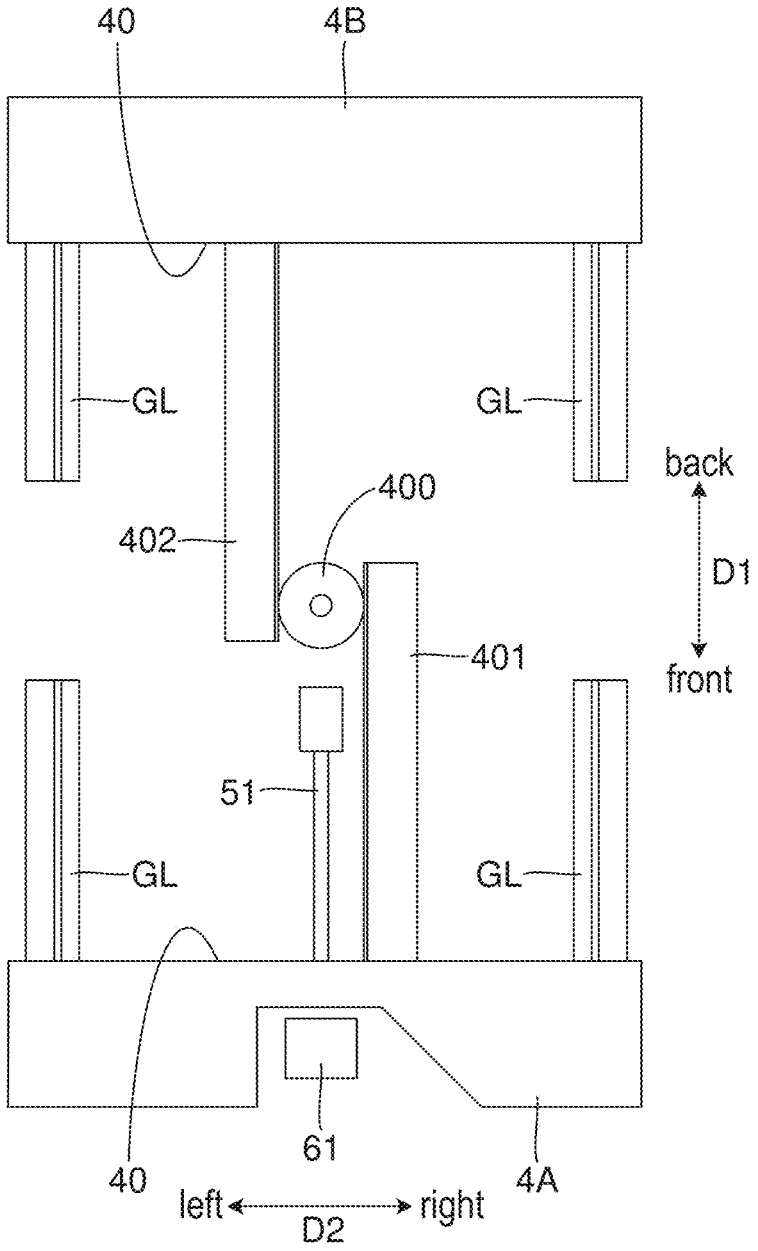
FIG. 7 is a schematic diagram (a plan view viewed from above) of a mechanism for moving a pair of width direction regulation cursors of the sheet storage device according to the embodiment.

In order to move the width direction regulation cursors 4A and 4B in the first direction D1 in an interlocking manner, as illustrated in FIG. 7, the width direction regulation cursor 4A is provided with a rack 401 that extends backward in the first direction D1, and the width direction regulation cursor 4B is provided with a rack 402 that extends frontward in the first direction D1. Between the racks 401 and 402 in the second direction D2, there is disposed a gear 400 that rotates about an axis extending in the up and down direction. The gear 400 engages with the racks 401 and 402.

In order to enable reciprocating movement of the width direction regulation cursor 4A in the first direction D1, the sheet storage device 100 is equipped with a cursor movement mechanism including a guide shaft 51, a guide rail GL, and the like. The guide shaft 51 and the guide rail GL extend in the first direction D1, so as to guide reciprocating movement of the width direction regulation cursor 4A in the first direction D1. In addition, the cursor movement mechanism includes a stopper (not shown). The stopper is linked with the width direction regulation cursor 4A.

The stopper has a guide hole in which the guide shaft 51 is inserted. When the stopper is inclined, frictional resistance between the guide shaft 51 and inner edge of the guide hole restricts movement of the width direction regulation cursor 4A in the first direction D1. Note that the stopper is biased by a biasing member (not shown) such as a coil spring so that the stopper is normally inclined.

The cursor movement mechanism includes a lever 61 to allow the stopper to change from the inclined state to a standing state. The lever 61 is operated by the user. When the lever 61 is operated, it presses the stopper in the direction in which the stopper changes from the inclined state to a standing state. When the lever 61 is operated, the stopper in the inclined state is raised, and the stopper changes to the standing state. In this way, the reciprocating movement of the width direction regulation cursor 4A in the first direction D1 is enabled.

<Opening and Closing Mechanism of Top Cover>

As illustrated in FIGS. 1 and 2, the top cover CV includes an operation part 70 that is a right side end part in the second direction D2. When opening or closing the top cover CV (i.e., when storing the sheets S), the user grasps the operation part 70. When the operation part 70 is lifted up, the top cover CV opens. When the operation part 70 is pushed down, the top cover CV is closed. For instance, a part of the top cover CV may be recessed downward, so that the recessed part can be made as the operation part 70. The top cover CV is pivotable on a fulcrum of the left side end part in the second direction D2, by swinging the right side end part in the second direction D2 as the operation part 70. The top cover CV pivots so as to open or close the upper opening of the sheet storage region.

The top cover CV is supported so as to pivot between a closed position and an opened position. In FIG. 2, a position of the top cover CV shown by a solid line is the closed position, while a position of the top cover CV shown by a broken line is the opened position. In the closed position, the top cover CV covers the sheet storage region from above. The top cover CV pivots from the closed position to the opened position, so as to open above the sheet storage region.

Figure 8:
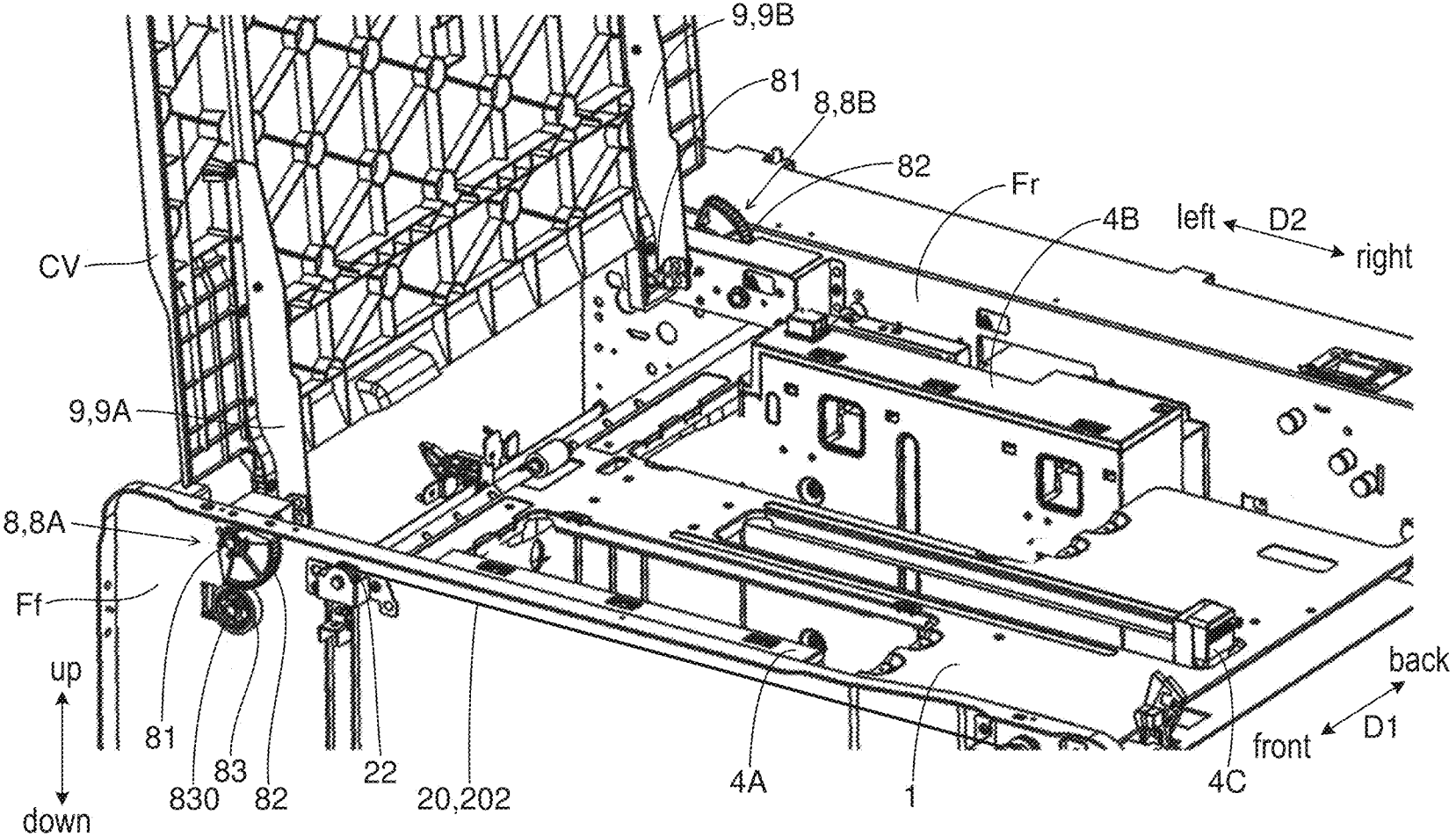
FIG. 8 is a perspective view illustrating a positional relationship between a top cover and a torque retention mechanism of the sheet storage device according to the embodiment.
Figure 9:
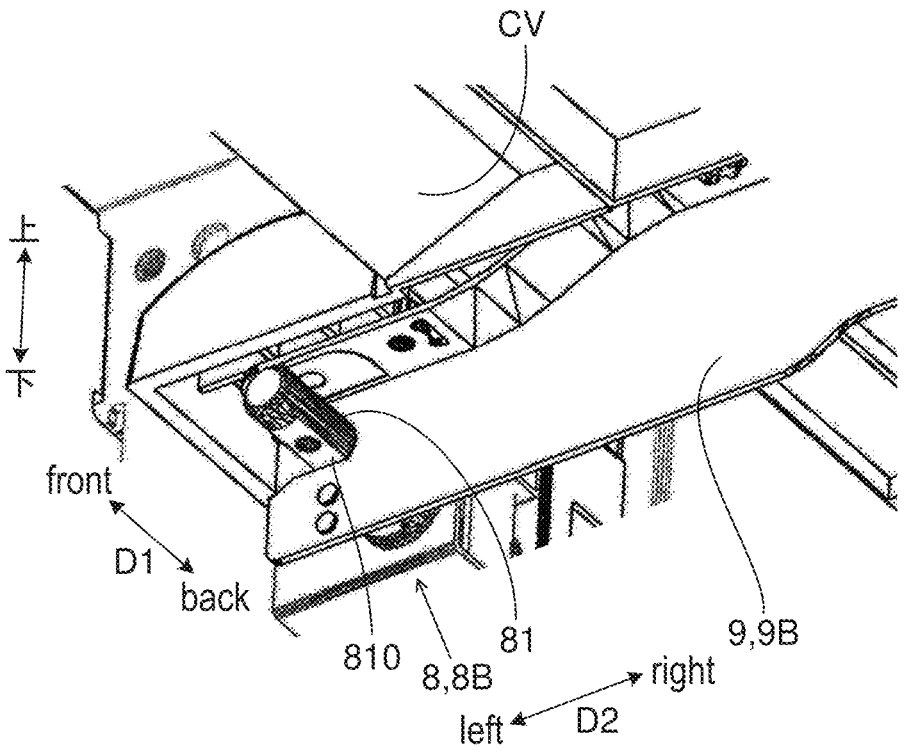
FIG. 9 is a perspective view illustrating a structure for attaching the top cover to the torque retention mechanism (shaft) of the sheet storage device according to the embodiment.
Figure 10:
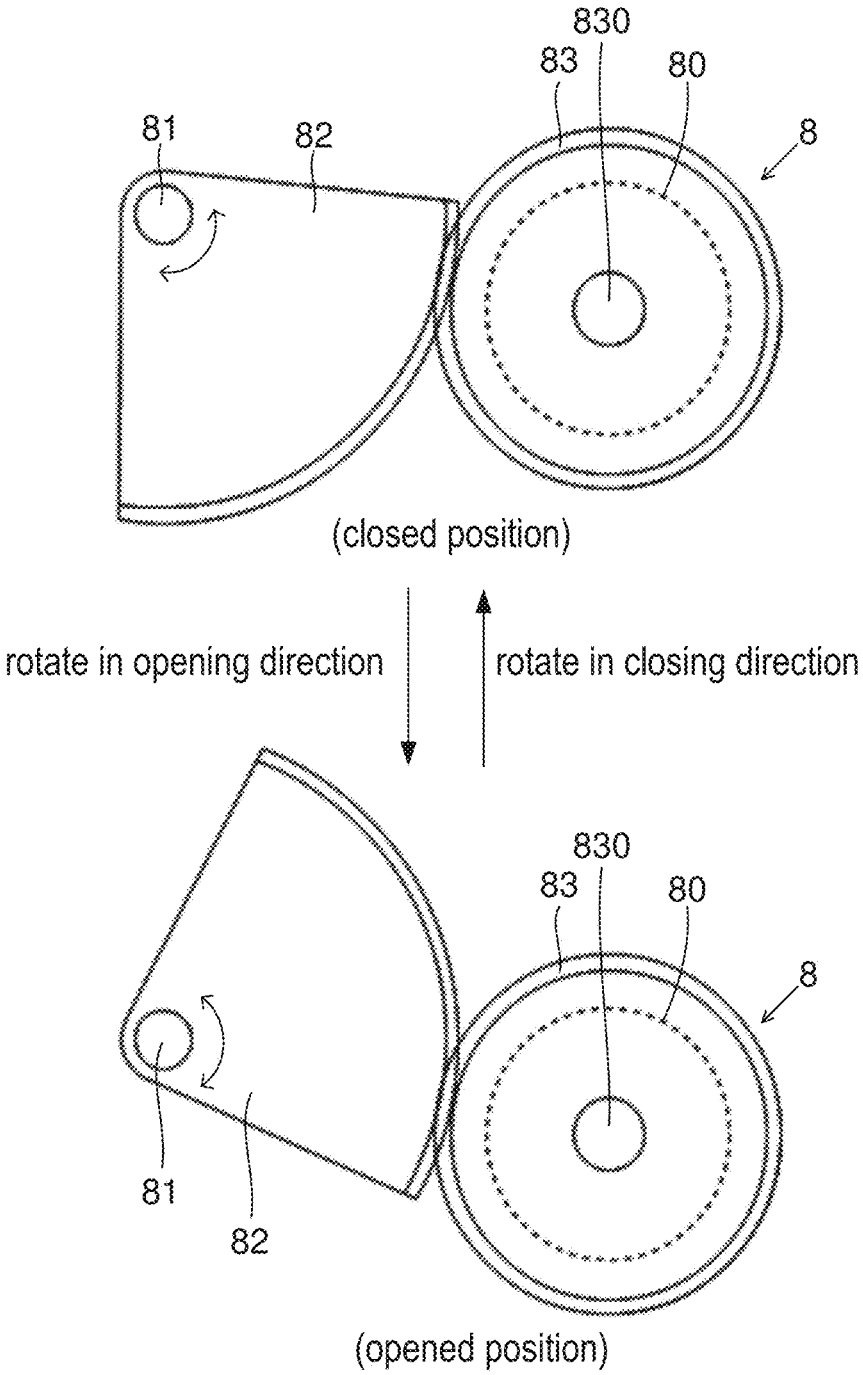
FIG. 10 is a schematic diagram of the torque retention mechanism of the sheet storage device according to the embodiment.

The sheet storage device 100 supports the top cover CV by the opening and closing mechanism illustrated in FIGS. 8 to 10. Specifically, in order to support the top cover CV in a pivotable manner (i.e., in an openable and closable manner), the sheet storage device 100 includes a torque retention mechanism 8. In addition, the top cover CV has a support part 9 that is supported by the torque retention mechanism 8.

The torque retention mechanism 8 includes a shaft 81. The shaft 81 is a round bar, and its axial direction is the first direction D1 (i.e., it extends in the first direction D1). The shaft 81 is supported in a rotatable manner. The shaft 81 is attached to the support part 9.

For instance, the shaft 81 has a D-cut part 810 cut in a D-shape. The support part 9 has a part (no numeral) that can be engaged with the D-cut part 810. The D-cut part 810 of the shaft 81 and its vicinity are shown in FIG. 9.

The support part 9 is engaged with the D-cut part 810. In this way, the top cover CV is attached to the shaft 81. In this state, the shaft 81 is disposed on the left side end part of the top cover CV in the second direction D2. The shaft 81 rotates in conjunction with pivoting (i.e., opening or closing) of the top cover CV. FIG. 9 illustrates the shaft 81 of a second torque retention mechanism 8B and a second support part 9B described later, but a first torque retention mechanism 8A and a first support part 9A described later have the same structure as those.

The shaft 81 is to be a pivot shaft of the top cover CV. In other words, the top cover CV pivots (i.e., opens or closes) on a fulcrum of the shaft 81. When the top cover CV pivots to the closed position, the shaft 81 rotates in one direction. When the top cover CV pivots to the opening direction, the shaft 81 rotates in the other direction opposite to the one direction.

The torque retention mechanism 8 generates a resistance torque against rotation of the shaft 81 when the top cover CV pivots to the closed position (i.e., rotation in one direction). In other words, the torque retention mechanism 8 generates the resistance torque against rotation of the shaft 81 in one direction, so as to regulate pivoting of the top cover CV to the closed position. On the other hand, the torque retention mechanism 8 does not generate the resistance torque against rotation of the shaft 81 when the top cover CV pivots to the opened position (i.e., rotation in the other direction), but allows the shaft 81 to skid.

In this structure, when opening the top cover CV, the top cover CV can be pivoted to the opened position without large resistance (i.e., by a small power). On the other hand, when closing the top cover CV, it is necessary to push down the top cover CV with a relatively large power.

The torque retention mechanism 8 allows rotation of the shaft 81 in one direction as a torque of a certain level or more in one direction is applied to the shaft 81. Note that the torque retention mechanism 8 does not allow the top cover CV to pivot to the closed position by its weight. In this way, the torque retention mechanism 8 enables to keep the top cover CV at any position between the opened position and the closed position.

Here, the torque retention mechanism 8 includes the first torque retention mechanism 8A and the second torque retention mechanism 8B. The first torque retention mechanism 8A is disposed on the front frame Ff. The second torque retention mechanism 8B is disposed on the rear frame Fr. In addition, the top cover CV is provided with the first support part 9A and the second support part 9B as the support part 9. The first support part 9A is disposed on the front frame Ff side. The second support part 9B is disposed on the rear frame Fr side.

The first torque retention mechanism 8A and the second torque retention mechanism 8B each include the shaft 81 separately. Each of the first torque retention mechanism 8A and the second torque retention mechanism 8B has one shaft 81.

The shaft 81 of the first torque retention mechanism 8A is attached to the first support part 9A, and the shaft 81 of the second torque retention mechanism 8B is attached to the second support part 9B. In other words, the first torque retention mechanism 8A supports the top cover CV on the front frame Ff side, and the second torque retention mechanism 8B supports the top cover CV on the rear frame Fr side.

The shafts 81 of the first torque retention mechanism 8A and the second torque retention mechanism 8B are disposed on the same axis. However, the shafts 81 of the first torque retention mechanism 8A and the second torque retention mechanism 8B are not directly linked with each other. In other words, the shafts 81 of the first torque retention mechanism 8A and the second torque retention mechanism 8B are not constituted as both end parts of a single shaft, extending from the front side to the back side in the first direction D1. The shafts 81 of the first torque retention mechanism 8A and the second torque retention mechanism 8B are independently rotatable. Each of the first torque retention mechanism 8A and the second torque retention mechanism 8B generates the resistance torque against rotation of its shaft 81 in one direction.

Each of the first torque retention mechanism 8A and the second torque retention mechanism 8B includes a torque generation unit 80 linked with its shaft 81. The torque generation unit 80 includes a torque limiter, for example. The torque generation unit 80 generates the resistance torque against rotation of the linked shaft 81 in one direction. The torque generation unit 80 allows the linked shaft 81 to skid when it rotates in the other direction opposite to the one direction.

Each of the first torque retention mechanism 8A and the second torque retention mechanism 8B includes a drive train that connects its own shaft 81 and torque generation unit 80. The first torque retention mechanism 8A and the second torque retention mechanism 8B each include, as the drive train, a sector gear 82 that is attached to the shaft 81 so as to rotate with the shaft 81, and a gear 83 that is engaged with the sector gear 82. The torque generation unit 80 is linked with a rotation shaft 830 of the gear 83.

Note that the torque generation unit 80 is not illustrated in FIGS. 8 and 9. Instead, FIG. 10 schematically illustrates a structure of the torque retention mechanism 8 including the torque generation unit 80, the shaft 81, the sector gear 82, and the gear 83. FIG. 10 corresponds to a plan view in which the torque retention mechanism 8 is viewed from the first direction D1.

The upper section of FIG. 10 illustrates the state where the top cover CV is in the closed position. The lower section of FIG. 10 illustrates the state where the top cover CV is in the opened position. When the top cover CV pivots in the opening direction from the state of the upper section of FIG. 10 to the opened position, the shaft 81 (the sector gear 82) rotates in a counterclockwise direction, and the gear 83 rotates in a clockwise direction. When the top cover CV pivots in the closing direction from the state of the lower section of FIG. 10 to the closed position, the shaft 81 (the sector gear 82) rotates in a clockwise direction, and the gear 83 rotates in a counterclockwise direction.

The positional relationship between the shaft 81 and the gear 83 viewed from the first direction D1 is not particularly limited. Viewed from the first direction D1, the gear 83 may be disposed on either one side or the other side of the shaft 81 in the second direction D2. In addition, viewed from the first direction D1, the gear 83 may be disposed on either the upper side or the lower side of the shaft 81.

Here, in this embodiment, as the sector gear 82 is used, depending on the position of the sector gear 82 in the rotation direction, engagement between the sector gear 82 and the gear 83 may be released. If the engagement between the sector gear 82 and the gear 83 is released, the resistance torque cannot be generated. Therefore, it is necessary to appropriately adjust the position of the sector gear 82 in the rotation direction so that the engagement between the sector gear 82 and the gear 83 cannot be released.

Therefore, in this embodiment, the first torque retention mechanism 8A and the second torque retention mechanism 8B each include the shaft 81 separately. In this way, the position of the D-cut part 810 in the rotation direction can be adjusted separately on both sides in the first direction D1. As a result, it is easy to adjust the position of the sector gear 82 in the rotation direction. In other words, in the structure for supporting the top cover CV by the torque retention mechanism 8 in an openable and closable manner, workability in assembling the top cover CV is improved. If a single long shaft extending from the front frame Ff to the rear frame Fr is used as the shaft 81 attached to the top cover CV, the position of the D-cut part 810 in the rotation direction cannot be adjusted separately on both sides in the first direction D1.

In addition, in this embodiment, the front side in the first direction D1 is the front of the device, and the work of assembling the top cover CV is performed from the front side in the first direction D1. In other words, a worker for assembling the top cover CV performs the work from the front side to the back side in the first direction D1.

Therefore, in this embodiment, at least the sector gear 82 and the gear 83 of the first torque retention mechanism 8A are disposed on the opposite side of the sheet storage region side of the front frame Ff. At least the sector gear 82 and the gear 83 of the second torque retention mechanism 8B are disposed on the sheet storage region side of the rear frame Fr. In this way, the worker for assembling the top cover CV can perform substantially all the work from one direction, which is convenient. In other words, workability in assembling the top cover CV can be more improved.

The embodiment disclosed in this specification is merely an example in every aspect, and should not be interpreted as a limitation. The scope of the present disclosure is defined not by the above description of the embodiment but by the claims, and should be understood to include all modifications within meaning and scope equivalent to the claims.

What is claimed is:

1. A sheet storage device comprising:

first and second frames disposed to face each other in a first direction perpendicular to an up and down direction, with a storage region of sheets between them;

a cover supported so as to pivot between a closed position and an opened position, on a fulcrum of an end part in a second direction perpendicular to the first direction in a horizontal direction, the cover covering the storage region from above when being in the closed position, and the cover pivoting from the closed position to the opened position so as to open above the storage region; and a torque retention mechanism including at least one shaft to be at least one pivot shaft of the cover and to rotate in conjunction with pivoting of the cover, the torque retention mechanism being configured to generate a resistance torque against rotation of the at least one shaft when the cover pivots to the closed position, wherein the cover has a support part supported by the torque retention mechanism, each shaft of the at least one shaft has a D-cut part cut in a D-shape, the support part has a part that is engageable with the D-cut part, with the support part engaged with the D-cut part, the cover is attached to the at least one shaft, the torque retention mechanism includes a first torque retention mechanism disposed on the first frame, and a second torque retention mechanism disposed on the second frame, the first and second torque retention mechanisms each include the at least one shaft separately, the cover is provided with a first support part and a second support part as the support part, the first support part is disposed on a first frame side and the second support part is disposed on a second frame side, the at least one shaft including a shaft of the first torque retention mechanism attached to the first support part of the cover disposed on the first frame side, a shaft of the second torque retention mechanism attached to the second support part of the cover disposed on the second frame side, and the shafts of the first and second torque retention mechanisms are not coupled to each other and are rotatable individually, and the first support part is fitted in the D-cut part of the shaft of the first torque retention mechanism and the second support part is fitted in the D-cut part of the shaft of the second torque retention mechanism.

2. The sheet storage device according to claim 1, wherein the first torque retention mechanism and the second torque retention mechanism each include a sector gear attached to the shaft so as to rotate with the shaft, a gear configured to engage with the sector gear, and a torque generation unit linked with a rotation shaft of the gear so as to generate the resistance torque.

3. The sheet storage device according to claim 2, wherein at least the sector gear and the gear of the first torque retention mechanism are disposed on the opposite side of the storage region side of the first frame, and at least the sector gear and the gear of the second torque retention mechanism are disposed on the storage region side of the second frame.

4. An image formation system comprising:

the sheet storage device according to claim 1; and an image forming apparatus linked with the sheet storage device, wherein the sheet storage device feeds the image forming apparatus with the sheet, and the image forming apparatus performs printing on the sheet fed from the sheet storage device.

* * * * *